US006233991B1

(12) United States Patent
Thimmel et al.

(10) Patent No.: US 6,233,991 B1
(45) Date of Patent: May 22, 2001

(54) APPARATUS AND METHOD FOR SPIN FORMING A TUBE

(75) Inventors: Frederick H. Thimmel, Hartland, WI (US); Per Carlson, Garden Grove; David S. Grupenhagen, Santa Ana, both of CA (US); Carljohan Lorentzen, Huntington Beach, CA (US); Henri T. Nguyen, Garden Grove, CA (US); Herbert L. Franck, San Pedro, CA (US)

(73) Assignee: Bryant Products, Inc., Ixonia, WI (US)

( * ) Notice: Subject to any disclaimer, the term of this patent is extended or adjusted under 35 U.S.C. 154(b) by 0 days.

(21) Appl. No.: 09/630,079

(22) Filed: Aug. 1, 2000

Related U.S. Application Data

(63) Continuation of application No. 09/237,586, filed on Jan. 26, 1999, now abandoned.

(51) Int. Cl.[7] ..... B21B 19/16
(52) U.S. Cl. ..... 72/84; 72/100
(58) Field of Search ..... 72/81, 82, 83, 72/84, 85, 100

(56) References Cited

U.S. PATENT DOCUMENTS

| | | | |
|---|---|---|---|
| 374,703 | 12/1887 | Ritchie . | |
| 2,162,327 | 6/1939 | Dewey et al. | 113/53 |
| 2,284,377 | 5/1942 | Dewey et al. | 113/53 |
| 2,559,360 | 7/1951 | Kurzwell et al. | 29/90 |
| 3,019,678 | 2/1962 | LeFiell | 80/14 |
| 3,029,767 | 4/1962 | Sporck | 113/52 |
| 3,041,990 | 7/1962 | LeFiell | 113/52 |
| 3,537,287 | 11/1970 | Schwartz et al. | 72/81 |
| 3,632,273 | 1/1972 | Savickas | 425/392 |
| 3,874,208 | 4/1975 | Werner | 72/84 |
| 4,036,044 | 7/1977 | Yoshimura | 72/85 |
| 4,038,850 | 8/1977 | Sakagami | 72/85 |
| 4,047,413 | 9/1977 | Lewis et al. | 72/83 |
| 4,953,376 | 9/1990 | Merlone | 72/57 |
| 5,125,251 | 6/1992 | Petterson et al. | 72/15 |

FOREIGN PATENT DOCUMENTS

| | | | |
|---|---|---|---|
| 227520 | 10/1987 | (JP) | 72/84 |

*Primary Examiner*—Lowell A. Larson
(74) *Attorney, Agent, or Firm*—Jansson, Shupe & Munger, Ltd.

(57) ABSTRACT

An improved apparatus and method are provided for spin-forming tapered rollers, including but not limited to conveyor rollers, drum pulleys, web feed rollers and the like, from a tube without using any internal or external supports between the ends of the tube. The apparatus includes first and second clamp assemblies which support opposite ends of the tube. A rotation structure rotates the tube as a plurality of rollers engage the outer surface thereof. The rollers move between the clamp assemblies to alter the outer diameter of the tube during travel. A controller controls the urging of the rollers against the tube and controls the movement of the rollers between the clamp assemblies.

18 Claims, 4 Drawing Sheets

APPARATUS AND METHOD FOR SPIN FORMING A TUBE

RELATED APPLICATION

This application is a continuation of U.S. Ser. No. 09/237,586, filed Jan. 26, 1999, now abandoned, and entitled AN APPARATUS AND METHOD FOR SPIN FORMING A TUBE.

FIELD OF THE INVENTION

This invention relates generally to the field of metal spinning and, more specifically, to the forming of tapered rollers (such as conveyor rollers, drum pulleys, web feed rollers, conveyor belt troughing idlers, conveyor belt troughing rollers) and the like from tubes.

BACKGROUND AND SUMMARY OF THE INVENTION

Tapered rollers are used for a wide variety of purposes. Simply by way of example, conveyor systems for moving finished and unfinished products to various locations in facilities such as factories and distribution warehouses often use endless moving flexible belts and/or sequences of rollers, and such conveyor systems typically include tapered rollers to form turns and spiral sections of conveying paths. Another related use for tapered rollers includes web feed rollers used in the production and/or processing of paper or plastic films. Still another is for conveyor drum pulleys used at the ends of belt conveyors; conveyor drum pulleys include outer drums, side panels, and hub assemblies of various constructions that either accept shafts or have shafts welded thereto. The drum face of a pulley can be straight, or can be point crowned, trapezoidally crowned, arc crowned or machined to special shapes; in some cases grooving is included for belt tracking strips.

Tapered rollers for these and other purposes may be made from various metals, thermoplastic materials, or combinations of both. Formation of tapered rollers for apparatus of the types referenced above are often formed by a metal-spinning process, and it is to formation of tapered rollers by metal spinning that the present invention is directed. As used herein, the term "tapered rollers" refers to rollers with outer surfaces which are off-cylindrical in any of several ways, whether by constant-rate straight-profile tapering along their lengths, by multiple-taper tapering, by variable-rate tapering, by crowning, or by other kinds of variations in outer roller profiles.

Metal spinning is an old technology wherein a round metal blank is positioned over a rotating mandrel. As is known to those skilled in the art, during most metal spinning processes rotating rollers engage the metal blank while traveling inwardly along a Y-axis toward the center of the mandrel and simultaneously traveling along an X-axis. The rotation of the mandrel coupled with the X-Y movement of the spinning rollers gradually spin-forms the flat disk of material over the mandrel to produce a finished shape of which the mandrel is a mirror image.

Alternatively, in the case of the tapered rollers or pulleys, the most common industrial practice is to form such rollers by metal-forming machines known as swaging machines.

Such a machine has a set of rotating rollers that directly or indirectly impact a set of dies containing a mirror image of the outer diameter of the part to be formed. By way of example, in order to form a tapered roller, a cylindrical tube or pipe is positioned on a mandrel, and the rotating rollers engage the surface of the tube to form it into the shape of the mandrel.

Similarly, pulleys are typically formed from sections of tubing or pipe. For example, when a crowned pulley is desired, the crown is formed by swaging the outside end of the tubing toward the mid-point thereof, and thereafter reversing the feed and swaging from the opposite end of tubing toward the center thereof to form a crowned center. Alternatively, a crowned pulley may be formed by using an expansion mandrel and forming the crown from the inside of the tube or by positioning an air or hydraulic bladder inside the tubing and expanding the tubing outwardly into a cavity mold that is a mirror image of the outside profile of the desired pulley.

While adequate for certain applications, prior art swaging machines have significant limitations. For example, the length and quality of tapered rollers formed by prior swaging machines has been limited by the lengths of the dies. Even in the largest swaging machines, the longest dies available are 20–24 inches in length. In order to form tapered rollers of longer lengths, multiple passes through a series of dies are required, and this adds to tooling costs, set-up times and processing times. Also, it is known that transition from one die to another often leads to visible breaks or ridges in the tapered surfaces of rollers when viewing the part as a whole. Such breaks or ridges are objectionable to some uses of such components.

Furthermore, swaging operations typically involve significant up-front capital costs. For example, differing initial diameters, finishing diameters and rates of taper may necessitate that specific dies be manufactured for each tapered roller. For larger swaging machines, such dies may cost several thousand dollars. Such high costs have acted as a deterrent to many who would seek to enter the business against competitor that already possess tooling. Moreover, swaging is a high impact, rapid hammering type of operation resulting in high maintenance costs of dies, rotating roller rings and internal parts. It can also be appreciated that use of an internal mandrel prevents the forming of drive grooves for a conveyor drum roller, and prevents the formation of tapering on opposite ends of a tube because the mandrel cannot be extracted after formation.

Swaging, air/hydraulic bladder and other mechanically-expandable mandrel methods of forming crowned pulleys do not produce concentricity or the run-out typically required by manufacturers of conveyors having high operating speeds. In addition, these methods currently only produce point-crowned pulleys having straight tapers. It is known that certain roller configurations tend to reduce the useful life spans of certain types of conveyor belts. Certain belt-friendly surface forms, such as trapezoidal crowns, trapezoidal crown, concave center and rounded crowns, are only available in pulleys having machined faces.

With these things in mind, there is a clear need in the industry for more readily produced rollers and pulleys of higher quality which can enable higher conveyor operating speeds. More generally, there is a clear need in the field of forming tapered metal rollers for an improved manufacturing equipment and methods.

The below-referenced United States patents disclose various devices that were said to be useful for the purposes for which they were intended. Without making any admissions as to pertinence to the present invention, the full disclosures of all below-referenced United States are incorporated here by reference.

U.S. Pat. No. 3,632,273 discloses a machine for converting plain plastic tubing such as polyvinyl chloride tubing and the like into simulated bamboo for use in the manufacture of furniture, etc. by forming on the plain plastic tubing a plurality of spaced peripheral ridges along the full length of the tubing. The machine supports a length of the tubing by means of pairs of rollers and heats the tubing between the rollers at the positions where ridges are to be formed as the tube is rotated. The pairs of rollers are mounted so that one roller may slide a short distance in the direction of the other roller. Upon heating, the sliding roller in each pair moves in the direction of the other roller and simultaneously forces the axial movement of the plastic tubing, forming peripheral or circumferential ridges on the plain plastic tubing. The tubing is then cooled off to cause the ridges to set.

U.S. Pat. No. 3,874,208 discloses a spinning adapter for spinning a tubular work piece to a predetermined decreased dimension. The adapter has a quill secured to the carriage of a machine tool having a headstock with a rotary chuck thereon to receive and rotate the work piece. The quill is hydraulically movable on the carriage in axial alignment with the headstock. A mandrel is adapted to be secured inside the quill at various positions and is of a size permitting insertion inside the work piece. The forward end of the quill has a plurality of circumferentially spaced reducing rollers. The rollers are journaled around the mandrel and brought into engagement with the work piece to spin the inside diameter of the work piece on the mandrel to the outside diameter of the mandrel. The reducing rollers are held in the reducing position by set screws in engagement with cam surfaces of rotatable arms to which the rollers are pivoted. The rollers and mandrel are simultaneously moved longitudinally relative to the work piece away from the headstock to accomplish the spinning operation.

U.S. Pat. No. 4,036,044 discloses a process for forming metal pipes to a desired shape and includes fitting a metal pipe onto a mold having the same profile as the one to be formed. The arrangement includes fixing the pipe thereon, and arranging a plurality of metal rollers spaced around the metal pipe. The rollers are arranged in such a manner that these rollers are in contact with the pipe and keep their centers on the circumference of a concentric circle. This is accomplished irrespective of the change in the position of the rollers during forward and backward movement of the rollers relative to the longitudinal center axis of the mold. The metal pipe is rotated with the mold in the longitudinal direction while the rollers are forced to move forwards and backwards.

U.S. Pat. No. 4,038,850 discloses a method of producing one-piece baseball bats from metal tubing by use of a forming machine without welding or joining individually processed portions. The process includes rotationally forming a portion of the body portion from the tubing which is re-chucked after working and followed by a turning over of the tubing which has been removed from the mandrel.

U.S. Pat. No. 4,047,413 discloses an automatic metal-spinning machine utilizing a plurality of work spindles which rotate about their respective axes. The machine has a parallel spinning-tool which rotates a shaft with variable pressure to apply a tool against a work piece. All the shafts simultaneously and continuously rotate around a central column so that plural metal blanks are progressively formed. Several parts are completed as the spindles and tool shafts make one revolution around the central column.

U.S. Pat. No. 4,953,376 discloses a metal spinning process and apparatus for necking-down a container. The apparatus has an open end, a closed end and generally cylindrical inner and outer surfaces. A resilient pressure bladder is inserted into the container prior to the necking-down operation. Pressure is maintained in the bladder during the operation to prevent crumpling of the container body. The invention is particularly useful for thin walled, deep drawn steel containers.

OBJECTS OF THE INVENTION

A primary object of the present invention to provide an improved apparatus and method for manufacture of tapered rollers from cylindrical tubing.

Another object of this invention is to provide an improved apparatus and method for manufacture of tapered rollers which overcomes shortcomings and problems of the prior art, including those referred to above.

Another object of this invention is to provide an improved spin-forming apparatus and method for manufacturing tapered rollers which greatly simplifies the spin-forming of a tube.

Yet another object of the present invention is to provide an improved apparatus for spin-forming tubes and/or selective reduction of tube diameter to form tapered, concave or convex crowns, which are simpler and less expensive than prior art spin-forming apparatus.

Another highly important object of this invention to provide an apparatus for spin-forming a tube that does not require either part-specific dies or any internal or external supports for the tube.

These and other objects of the invention will be apparent from the disclosure and discussion herein.

BRIEF SUMMARY OF THE INVENTION

In accordance with the present invention, an improved apparatus is provided for spin-forming a tube which extends along a longitudinal axis and has first and second ends and an initial outer diameter. Operation of the improved apparatus produces tapered rollers of various kinds, including but not limited to those referred to above, from cylindrical tubes.

The apparatus of this invention includes a first clamp assembly for movably supporting the first end of the tube and a second clamp assembly axially spaced from the first clamp assembly for removably supporting the second end of the tube. A rotation structure is operatively connected to at least one of the clamp assemblies for rotating the tube about the longitudinal axis. A pair of rollers are positioned on opposite sides of the tube for engaging the tube. Such rollers are rotatable about corresponding axes which are generally parallel to a longitudinal axis, and each roller is movable between a first position adjacent the first clamp assembly and a second position adjacent the second clamp assembly. A controller urges the outer surfaces of the rollers against the tube with a predetermined force and controls the movement of the rollers between the first and second positions as the outer surfaces of the rollers are urged against the tube to alter the outer diameter of the tube.

It is contemplated that the rotation structure be interconnected to the first clamp assembly and that the second clamp assembly be supported on a carriage. The carriage is movable along the longitudinal axis between a first open position in which the tube may be positioned between the clamp assemblies and a second clamping position in which the tube is supported by the clamp assemblies. The carriage is supported on and travels along the first and second rails. The rails are generally parallel to each other and to the longitudinal axis. It is contemplated that at least one of the clamp assemblies be free to move axially away from the other clamp assembly to accommodate any increase in the length of the tube in response to the altering of the outer diameter of the tube. Each clamp assembly includes an end member having a conical configuration for insertion into the corresponding end of the tube. A clamping member urges the clamp assemblies toward each other to capture the tube between the end members.

In accordance with a further aspect of the present invention, an apparatus is provided for spin-forming a tube. The tube extends along a longitudinal axis and has first and second ends and an initial, outer diameter. The apparatus includes a first clamp assembly for removably supporting the first end of the tube and a second clamp assembly, axially spaced from the first clamp assembly, for removably supporting the second end of the tube such that the tube is free from internal and external supports between the first and second clamp assemblies. A rotation structure is operatively connected to one of the clamp assemblies for rotating the tube along the longitudinal axis. First and second pairs of rotatable rollers are also provided. Each roller has a corresponding radially outer surface for engaging the tube and is movable laterally between the first position adjacent the first clamp assembly and a second position adjacent the second clamp assembly. A controller urges the outer surface of the rotatable rollers against the tube with a predetermined force and controls movement of the rotatable rollers between the first and second position to alter the outer diameter of the tube.

A clamping mechanism urges the clamp assemblies toward each other to capture the tube therebetween. One of the clamping assemblies is mounted on a carriage and is movable along a longitudinal axis between a first opened position wherein the tube may be positioned between the clamp assemblies and a second clamping position wherein the tube is supported by the clamp assemblies. At least one of the clamp assemblies is free to move away from the other clamp assembly to accommodate any increase in length of the tube in response to the altering of the outer diameter thereof.

In accordance with a still further aspect of the present invention, the method of spin-forming a tube is provided. The tube extends along a longitudinal axis and has first and second ends and an initial outer diameter. Significantly, the tube is free of internal and external supports between the first and second ends thereof. First and second rollers are provided which are rotatable about corresponding axis generally parallel to the longitudinal axis. The rollers are urged against the tube with a predetermined force and moved between the first and second ends of the tube to alter the outer diameter of the tube.

Each end of the tube is supported by a corresponding clamp assembly. The clamp assemblies are urged toward each other to capture the tube therebetween. At least one of the clamp assemblies is free to move away from the other clamp assembly to accommodate any increase of length in the tube in response to the altering of the outer diameter of the tube. The force of the rollers engaging tube may vary as the rollers move between the first and second ends of the tube.

Using the unique apparatus and method of this invention, a wide variety of tapered rollers can be produced from a cylindrical tube which during such production is free of any internal or external supports at positions between the first and second clamp assemblies. The apparatus and method of this invention allow quick, convenient and low-cost manufacture of tapered rollers. According to the present invention, spin-forming of tubes into tapered rollers is greatly facilitated and the cost of production is significantly reduced. Furthermore, the need for part-specific or configuration-specific tooling is eliminated.

BRIEF DESCRIPTION OF THE DRAWINGS

The drawings illustrate a preferred embodiment of the present invention in which the above advantages and features are clearly seen, as well as others which will be readily understood from the following description of the illustrated embodiment.

In the drawings.

Similar reference characters refer to similar parts throughout the various views of the drawings.

DETAILED DESCRIPTION OF PREFERRED EMBODIMENTS

Figure 1:
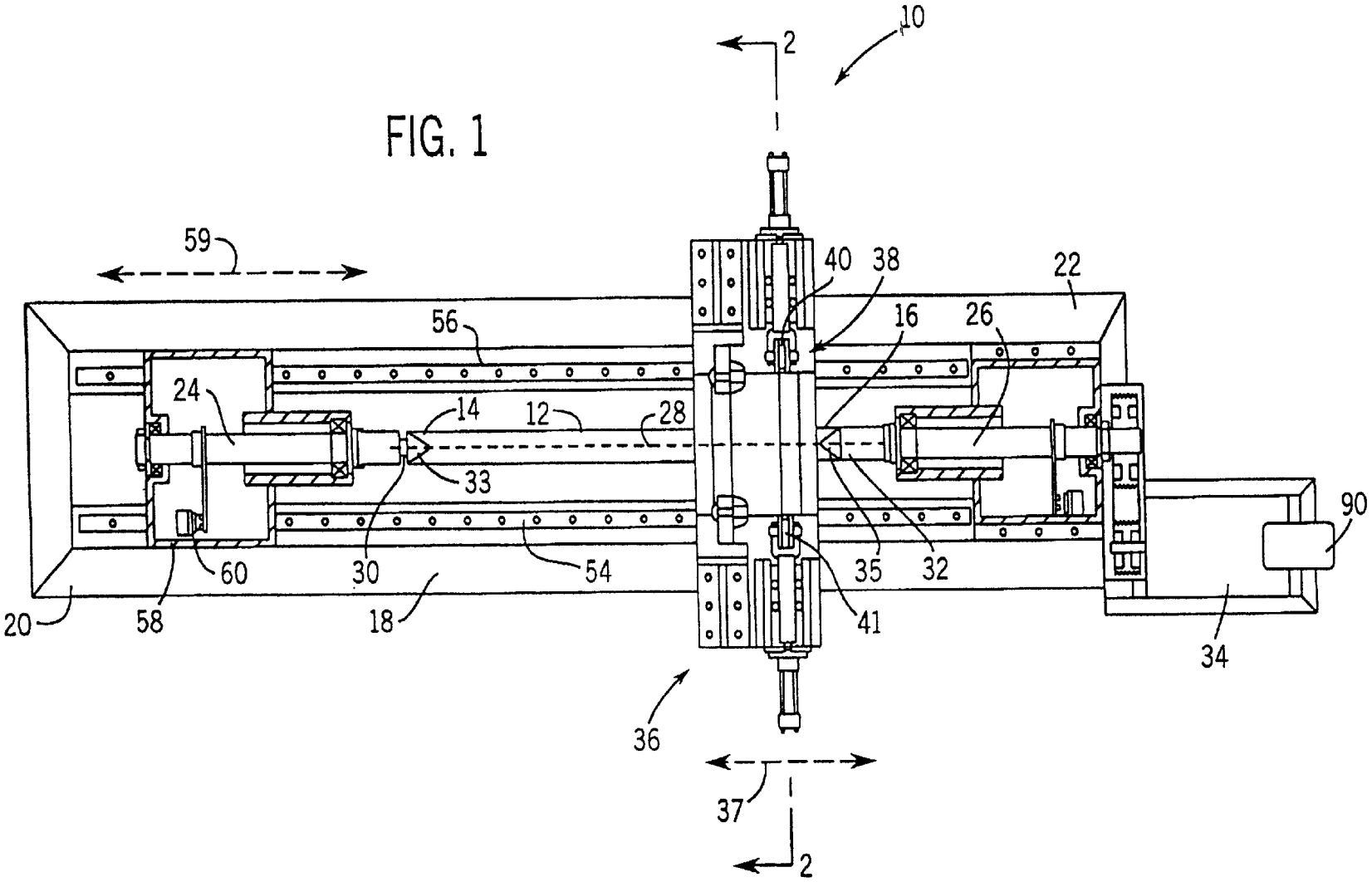
FIG. 1 is a top plan view of an apparatus for spin-forming a tube according to the present invention.

Referring to FIG. 1, an apparatus in accordance with the present invention is generally designated by reference numeral 10. Apparatus 10 is intended to spin-form various items, e.g., conveyor rollers, drum pulleys, web feed rollers, conveyor belt troughing pullers and the like, from a metal tube 12. As is conventional, tube 12 has an initial outer diameter; extends along longitudinal axis; and has first and second ends 14 and 16, respectively.

Apparatus 10 includes a frame 18 having first and second extremities 20 and 22, respectively. Frame 18 further includes first and second rails 54 and 56, respectively, which are generally parallel to and spaced relative to one another, and which extend between extremities 20 and 22 of frame 18.

Tailstock 24 is rotatably secured relative to a tailstock carriage 58, as shown in FIG. 1, and tailstock carriage 58, in turn, is slidably supported on rails 54 and 56 such that tailstock 24 is slidable along frame 18 at a location adjacent first extremity 20 of frame 18. Drive mechanism 62, shown in FIG. 3, controls movement of tailstock 24 along common axis 28 (as indicated by arrow 59) in a manner hereinafter described. Tailstock 24 includes a clamp 30 for removably fastening the first end 14 of the tube 12 to the tailstock 24 and a lube pump 60 for lubrication.

Figure 3:
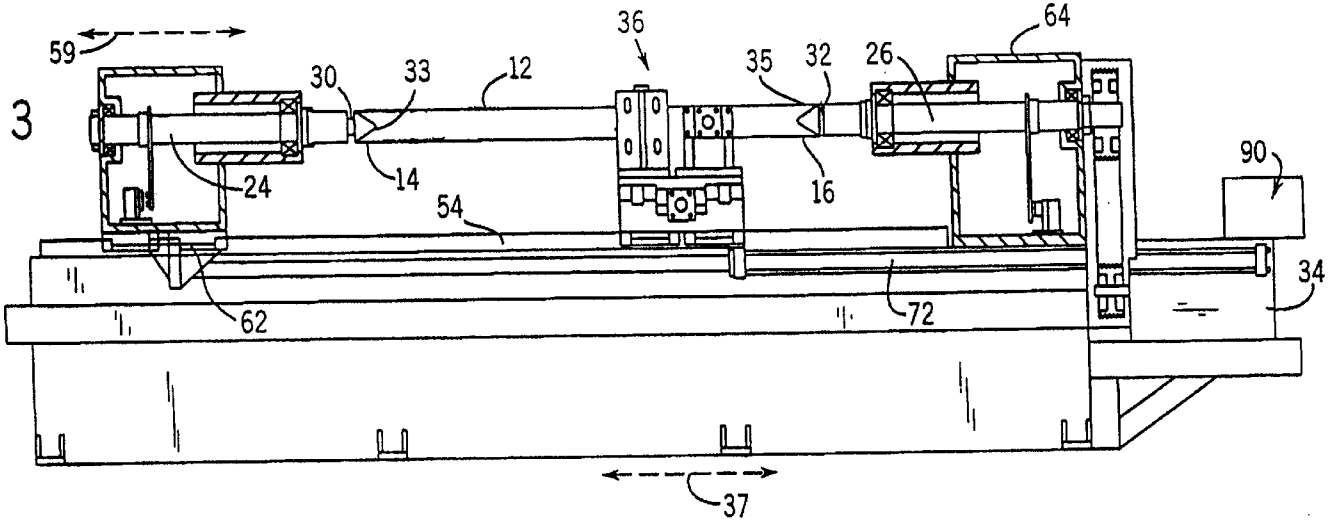
FIG. 3 is a side elevational view, partially in section, of the apparatus shown in FIG. 1.
Figure 4:
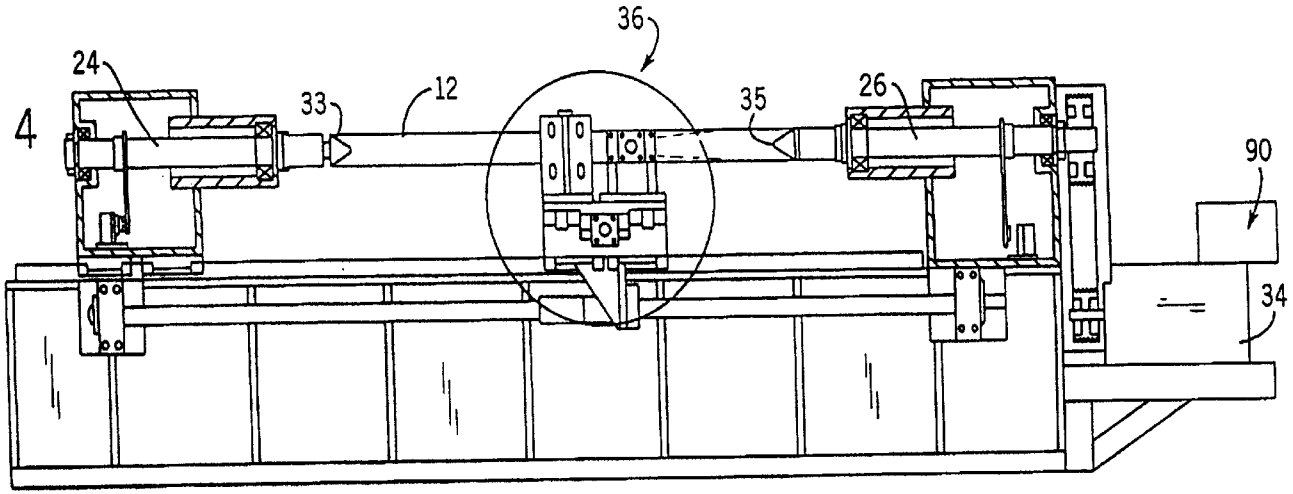
FIG. 4 is a similar view to FIG. 3 but showing the cross slide having moved axially from right to the left along the outer surface of the tube.
Figure 5:
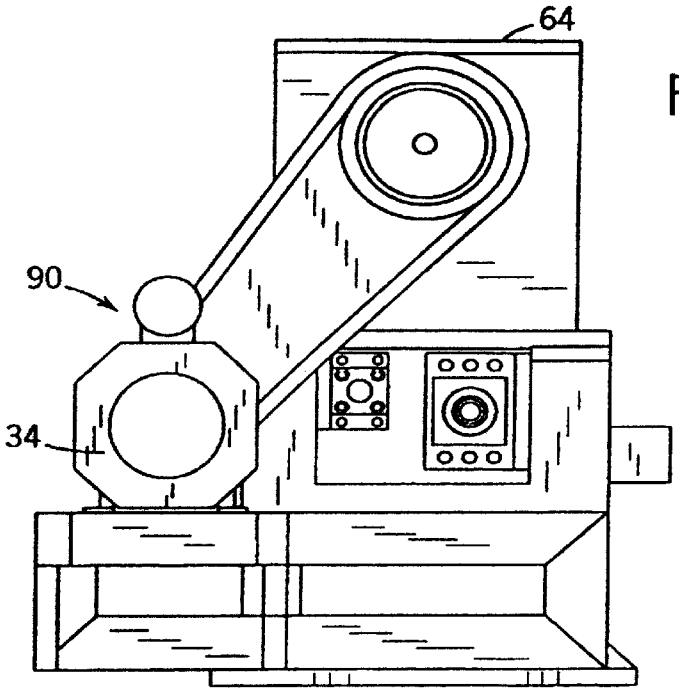
FIG. 5 is an end view of the apparatus shown in FIG. 2 viewed from a first side thereof.
Figure 6:
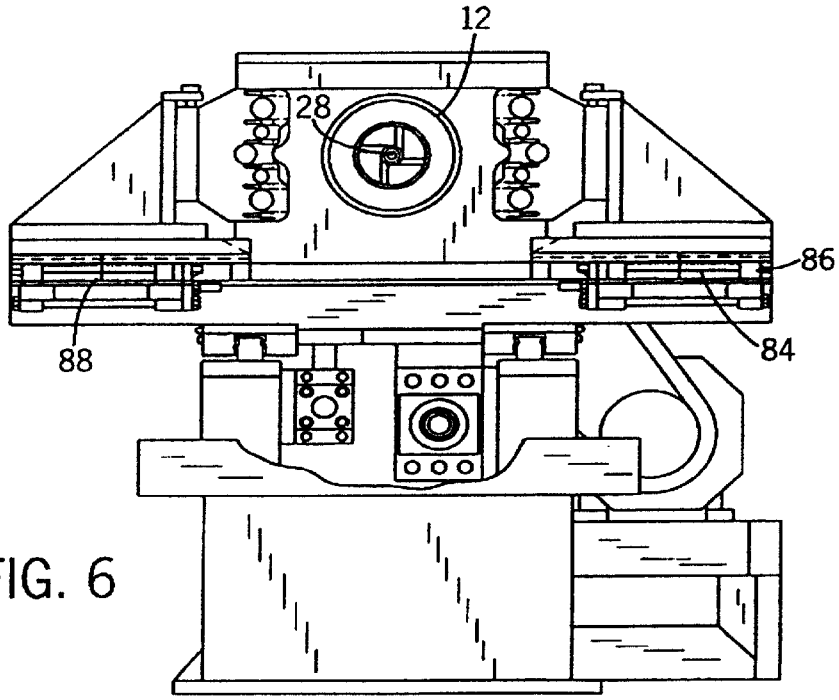
FIG. 6 is an end view of the apparatus shown in FIG. 2 but viewed from a second left side thereof.

Headstock 26 is mounted on frame 18 at a location adjacent to second extremity 22 of frame 18 such that headstock 26 and tailstock 24 lie on a common axis 28, illustrated by a dashed line. Headstock 26 is supported by headstock carriage 64, as shown in FIG. 3, and is operatively connected to motor 34 such that headstock 26 may be rotated about common axis 28. Headstock 24 includes a clamp 32 for removably fastening second end 16 of tube 12 to headstock 26. When supported by clamps 30 and 32 as described above, the longitudinal axis of tube 12 is coincident with axis 28.

Referring to FIG. 3, in the preferred embodiment, clamps 30 and 32 are chuck devices. However, as will be appreciated by those skilled in the art, other types of clamps may be use to fasten ends 14 and 16 of tube 12 relative to tailstock 24 and headstock 26, without deviating from the scope of the present invention. Clamps 30 and 32 include conical or domed shaped end members 33 and 35, respectively.

In order to mount tube 12 onto tailstock 24 and headstock 26, ends 14 and 16 of tube 12 are aligned with corresponding end members 33 and 35, respectively. End members 33 and 35 are drawn toward each other by drive mechanism 62 such that end members 33 and 35 are inserted within corresponding ends 14 and 16, respectively, of tube 12. As a result, tube 12 is captured between end members 33 and 35 and tube 12 is firmly supported between headstock 26 and tailstock 24. As described, when mounted on tailstock 24 and headstock 26, tube 12 is free of any internal or external supports such as mandrels or the like between clamps 30 and 32. Preferably, end members 33 and 35 are of a partial egg-shaped configuration and the angles of the walls of end members 33 and 35 are within the range 45–50 degrees relative to common axis 28.

With tube 12 mounted onto tailstock 24 and headstock 26 as heretofore described, motor 34 may spin headstock 26 which, in turn, spins tube 12. As a result, tailstock 24, which is clamped to tube 12 by clamp 30, also spins at a common rotational velocity as headstock 36.

Referring back to FIG. 1, a cross slide generally designated by numeral 36 is movably supported on and guided by rails 54 and 56 to allow cross slide 36 to move in a direction parallel to the common axis 28 as indicated by the arrow 37. As best seen in FIG. 3, cross slide 36 includes means 72 for moving cross slide 36 in a direction 37 parallel to the common axis 28 such that cross slide 36 is movable along frame 18 between tailstock 24 and headstock 26.

Figure 2:
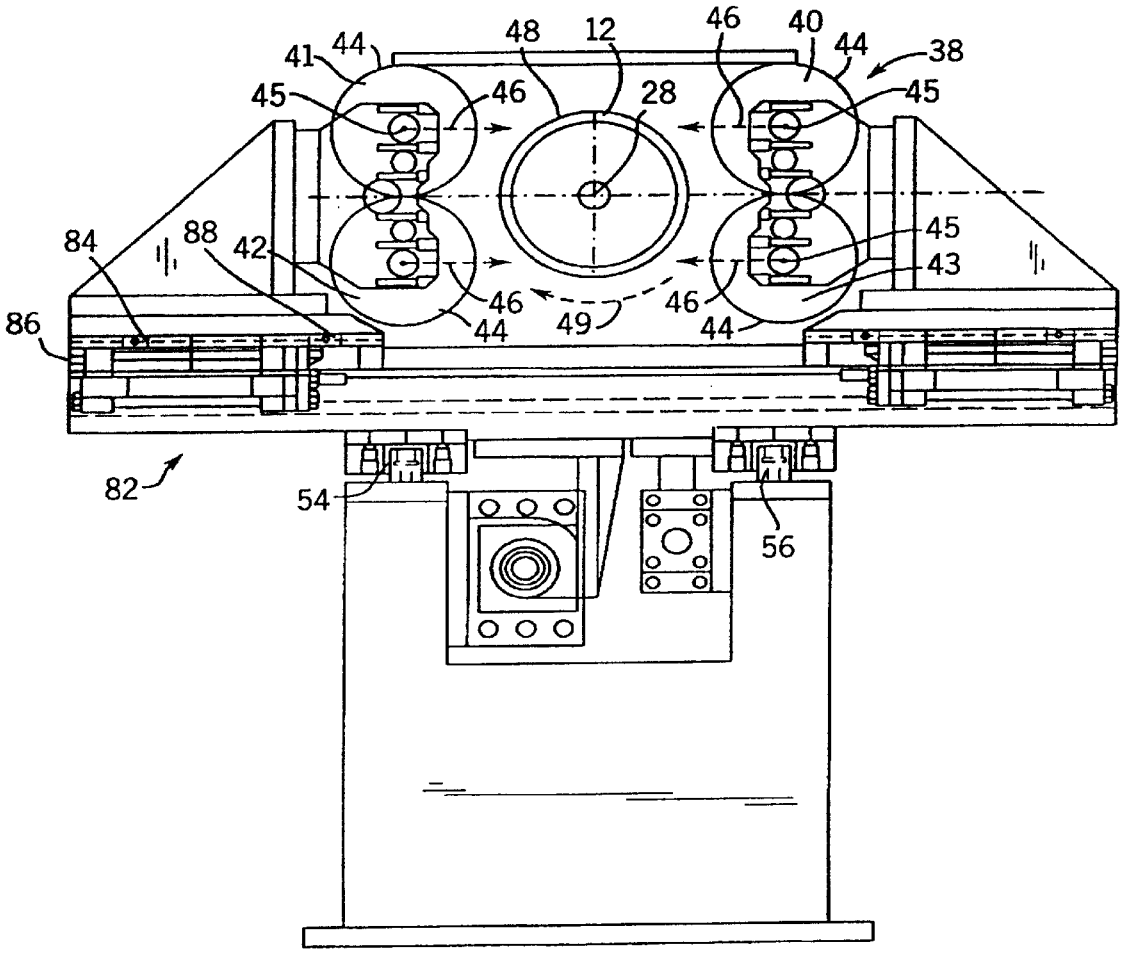
FIG. 2 is an enlarged sectional view taken along the line 2—2 of FIG. 1.

A roller assembly, generally designated by the reference numeral 38, is rotatably secured to cross slide 36. As best seen in FIG. 2, roller assembly 38 includes a plurality of forming rollers 40, 41, 42 and 43, which are spaced from each other and circumferentially spaced about the outer surface 48 of tube 12. Each of the forming rollers 40–43 defines a cylindrical outer surface 44 and is rotatable about a corresponding rotational axis 45 which is generally parallel to the common axis 28. As hereinafter described, forming rollers 40–43 are movable toward and away from common axis 28. By way of example, cylindrical surface 44 of forming roller 40 is movable in a path as indicated by the arrow 46 toward the common axis 28 so that the cylindrical surface 44 may engage the outer surface 48 of tube 12.

Means 82 are provided for controllably urging each of the forming rollers 40–43 toward the common axis 28. More specifically, in a first embodiment depicted in FIG. 1, 82 includes hydraulic cylinders 84 having first and second ends 86 and 88, respectively. First ends 86 of hydraulic cylinders 84 are connected to corresponding portions of cross slide 36, while forming rollers 40–43 are rotatably connected to second ends 88 of corresponding hydraulic cylinders 84. The arrangement is such that forming rollers 40 and 43 are rotatably supported by the second end 88 of one of the hydraulic cylinders 84 while forming rollers 41 and 42 are rotatably supported on a second end 88 of the other hydraulic cylinder 84. As described, actuation of hydraulic cylinder 84 urges forming rollers 40–43 toward a common axis 28 and into engagement with outer surface 48 of tube 12.

In an alternate embodiment, illustrated in FIGS. 2–6, a single hydraulic cylinder 84 is utilized such that first end 86 is operatively connected to rollers 41 and 42 through a first portion of cross slide 36 and second end 88 is operatively connected to rollers 40 and 43 through a second portion of cross slide 36. As such, by retracting second end 88 within hydraulic cylinder 84, the first and second portions of cross slide 36 are drawn toward each other such that rollers 40–43 are drawn toward common axis 28. In other words, when hydraulic fluid is drained from hydraulic cylinder 84, a piston and connecting rod which constitute the second end 88 of the cylinder 84 are moved toward first end 86 of hydraulic cylinder 84, so that the pair of rollers 40 and 43 move toward the pair of rollers 41 and 42. Although hydraulic cylinder 84 is connected to the cross slide 36, floating of the rollers 40, 43 and 41, 42 is permitted because hydraulic cylinder 84 is only guided by the cross slide 36 and is not anchored by the cross slide 36 against movement in direction 46 for modifying the outer surface 48 of tube 12.

In either embodiment, the arrangement is such that when tube 12 is spun, as indicated by arrow 49 in FIG. 2, forming rollers 40–43 permit tube 12 to freely float therebetween so that when cross slide 36 moves axially, as indicated by the arrow 37, along tube 12 and forming rollers 40–43 are urged inwardly as indicated by the arrows 36 against outer surface 48 of tube 12, tube 12 is worked and controllably shaped.

In the preferred embodiment of the present invention as shown in FIG. 3, the apparatus 10 includes a computerized control generally designated by the numeral 90 for controlling rotation of tube 12. Such computer controls are well-known to those skilled in the art. Generally, such systems are comprised of an input device or keyboard, a memory, a processor or may be of the type described in U.S. Pat. No. 4,149,235, the disclosure of which is incorporated by reference. Control 90 also controls axial movement of cross slide 36 as indicated in the arrow 37. Furthermore, computerized control 90 also controls movement of each of the forming rollers 40–43 toward common axis 28. Control 90 aids the present invention in forming parts, tapers and grooves economically and efficiently.

Referring to FIG. 2, each of the forming rollers 40–43 is movably guided in path 46 which is normal to common axis 28 so that when the plurality of forming rollers 40–43 move in the aforementioned path 46 toward common axis 28, outer surface 48 of tube 12 is modified without requiring any internal and external support for tube 12 between the ends thereof.

As hereinafter described, tube 12 is formed by a combination of: (a) inward movement of forming rollers 40–43 toward common axis 28 as indicated by arrow 46; (b) longitudinal movement of rollers 40–43 axially between tailstock 24 and headstock 26 parallel to common axis 28 as indicated by arrow 37; and (c) rotation of tube 12 about common axis 28 as indicated by arrow 49.

In operation, tailstock 24 and headstock 26 are separated by drive mechanism 62 to allow tube 12 to be positioned therebetween along common axis 28. First end 14 and second end 16 of tube 12 are interconnected to tailstock 24 and headstock 26, respectively, as heretofore described. Motor 34 is actuated to rotate headstock 26, and hence, tube 12, about common axis 28. Forming rollers 40–43 are guided along path 46 under the control of computerized control 90 such that the outer surfaces 44 of forming rollers 40–43 engage outer surface 48 of tube 12. Thereafter, cross slide 36 moves axially, as indicated by arrow 37, between headstock 26 and tailstock 24. With forming rollers 40–43 urged against outer surface 48 of tube 12, outer surface 48 of tube 12 is controllably shaped thereby such that the outer diameter of tube 12 is altered. Given that there are no internal or external supports for tube 12 between clamps 30 and 32, it can be appreciated that the shape of outer surface 48 of tube 12 may be modified to any of the plurality of user-desired shapes.

It can be further appreciated that the length of tube 12 may increase as tube 12 is spin-formed, as heretofore described. As such, it is contemplated that tailstock 24 be permitted to move away from headstock 26 during the spin-forming operation. Such movement of tailstock 24 away from headstock 26 may be by motorized of the pressure exerted by tube 12 on tailstock 24 during the forming operation.

As described, apparatus 10 according to the present invention provides a for spin-forming a tube 12 without requiring a supporting mandrel, internal bladder, mold, internal disks, or any supports of any kind disposed internally or externally of tube 12. This provides all of the significant advantages referred to above in facilitating formation of tapered rollers.

The individual components need not be formed in the disclosed shapes, or assembled in the disclosed configuration, but could be provided in virtually any shape, and assembled in virtually any configuration. Furthermore, although there are many physically separate modules, it will be manifest that they may be integrated into the modules with which they are associated. Furthermore, all the disclosed features of each disclosed embodiment can be combined with, or substituted for, the disclosed features of every other disclosed embodiment except where such features are mutually exclusive.

Various modes of carrying out the invention are contemplated as being within the scope of the following claims which particularly point out and distinctly claim the subject matter regarded as the invention.

We claim:

1. An apparatus for spin forming a tube extending along a longitudinal axis and having first and second ends and an initial, outer diameter, comprising:

a first clamp assembly for removably supporting the first end of the tube;

a second clamp assembly axially spaced from the first clamp assembly for removably supporting the second end of the tube that the tube being, the tube being free of internal and external supports between the first and second clamp assemblies when supported thereby;

a rotation structure operatively connected to at least one of the clamp assemblies for rotating the tube about the longitudinal axis;

first and second, circumferentially spaced, rotatable rollers having radially outer surfaces for engaging the tube, each rotatable roller rotatable about an axis generally parallel to the longitudinal axis and movable between a first position adjacent the first clamp assembly and a second position adjacent the second clamp assembly; and a controller for urging the outer surfaces of the rotatable rollers against the tube with a predetermined force and for controlling movement of the rotatable rollers between the first and second positions as the outer surfaces of the rotatable rollers are urged against the tube so as to alter the outer diameter of the tube.

2. The apparatus of claim 1 wherein the rotation structure is interconnected to the first clamp assembly and wherein the second clamp assembly is supported on a carriage, the carriage movable along the longitudinal axis between a first open position wherein the tube may be positioned between the clamp assemblies and a second clamping position wherein the tube is supported by the clamp assemblies.

3. The apparatus of claim 2 wherein the carriage is supported on and travels along first and second rails, the rails being generally parallel to each other and to the longitudinal axis.

4. The apparatus of claim 1 wherein at least one of the clamp assemblies is free to move axially away from the other clamp assembly to accommodate any increase in length of the tube in response to the altering of the outer diameter of the tube.

5. The apparatus of claim 1 wherein the first clamp assembly includes an end member having a conical configuration for insertion into the first end of the tube.

6. The apparatus of claim 5 wherein the second clamp assembly includes an end member having a conical configuration for insertion into the second end of the tube.

7. The apparatus of claim 6 further comprising a clamping mechanism for urging the clamp assemblies towards each other so as to capture the tube between the end members.

8. An apparatus for spin forming a tube extending along a longitudinal axis and having first and second ends and an initial, outer diameter, comprising:

a first clamp assembly for removably supporting the first end of the tube;

a second clamp assembly axially spaced from the first clamp assembly for removably supporting the second end of the tube, the tube being free of internal and external supports between the first and second clamp assemblies when supported thereby;

a rotation structure operatively connected to at least one of the clamp assemblies for rotating the tube about the longitudinal axis;

first and second pairs of rotatable rollers having corresponding radially outer surfaces for engaging the tube and being movable laterally between a first position adjacent the first clamp assembly and a second position adjacent the second clamp assembly; and a controller for urging the outer surfaces of the rotatable rollers against the tube with a predetermined force and for controlling movement of the rotatable rollers between the first and second positions so as to alter the outer diameter of the tube.

9. The apparatus of claim 8 further comprising a clamping mechanism for urging the clamp assemblies towards each other so as to capture the tube therebetween.

10. The apparatus of claim 9 wherein the clamping mechanism includes a carriage movable along the longitudinal axis between a first open position wherein the tube may be positioned between the clamp assemblies and a second clamping position wherein the tube is supported by the clamp assemblies.

11. The apparatus of claim 10 wherein the pairs of rotatable rollers are circumferentially spaced from each other about the longitudinal axis.

12. The apparatus of claim 8 wherein at least one of the clamp assemblies is free to move axially away from the other clamp assembly to accommodate any increase in length of the tube in response to the altering of the outer diameter of the tube.

13. A method of spin forming a tube extending along a longitudinal axis and having first and second ends and an initial, outer diameter, comprising the steps:

rotating the tube about the longitudinal axis, the tube being free of internal and external supports between the ends thereof;

providing first and second rollers which are rotatable about corresponding axis generally parallel to the longitudinal axis;

urging the rollers against the tube with a predetermined force; and moving the rollers between the first and second ends of the tube so as to alter the outer diameter of the tube.

14. The method of claim 13 wherein the rollers includes outer surface free of recesses.

15. The method of claim 13 comprising the additional steps of:

providing first and second space clamp assemblies; and supporting each end of the tube with a corresponding clamp assembly.

16. The method of claim 15 comprising the additional step of urging the clamp assemblies towards each other so as to capture the tube therebetween.

17. The method of claim 16 comprising the additional step of allowing at least one of the clamp assemblies to move freely away from the other clamp assembly to accommodate any increase in length of the tube in response to the altering of the outer diameter of the tube.

18. The method of claim 13 comprising the additional step of varying the predetermined force of the rollers against the tube as the rollers are moved between the first and seconds ends of the tube.

* * * * *

UNITED STATES PATENT AND TRADEMARK OFFICE

CERTIFICATE OF CORRECTION

PATENT NO. : 6,233,991 B1
DATED : May 22, 2001
INVENTOR(S) : Frederick H. Thimmel et al.

It is certified that error appears in the above-identified patent and that said Letters Patent is hereby corrected as shown below:

Column 4,
Line 63, delete "movably" and insert -- removably --.

Column 5,
Line 4, delete "a" and insert -- the --.
Lines 5, 6, 48 and 49, between "adjacent" and "the", insert -- to --.

Column 10,
Line 28, delete "that the tube being".
Lines 38 and 39, between "adjacent" and "the", insert -- to --.

Column 11,
Lines 25 and 26, between "adjacent" and "the", insert -- to --.
Line 33, delete "towards" and insert -- toward --.

Column 12,
Line 9, after "steps", insert -- of --.
Line 15, delete "axis" and insert -- axes --.
Line 31, delete "towards" and insert -- toward --.
Line 41, delete "seconds" and insert -- second --.

Signed and Sealed this

Twenty-third Day of April, 2002

*Attest:*

*Attesting Officer*

JAMES E. ROGAN
*Director of the United States Patent and Trademark Office*